United States Patent [19]

Morris

[11] Patent Number: 4,836,147

[45] Date of Patent: Jun. 6, 1989

[54] COOLING SYSTEM FOR AN INTERNAL COMBUSTION ENGINE

[75] Inventor: Peter T. Morris, Detroit, Mich.

[73] Assignee: Ford Motor Company, Dearborn, Mich.

[21] Appl. No.: 132,748

[22] Filed: Dec. 14, 1987

[51] Int. Cl.[4] ..... F01P 5/12; F04B 35/04

[52] U.S. Cl. ..... 123/41.44; 417/410; 417/32

[58] Field of Search ..... 123/41.44, 41.28, 41.74, 123/41.82 R; 417/410, 32, 411

[56] References Cited

U.S. PATENT DOCUMENTS

| | | | |
|---|---|---|---|
| 952,576 | 3/1910 | Parkhurst | 123/41.74 |
| 2,029,146 | 1/1936 | Wirrer | 123/41.82 |
| 2,782,721 | 2/1957 | White | 417/410 X |
| 3,306,221 | 2/1967 | Goodpasture | 417/420 |
| 3,411,450 | 3/1967 | Clifton | 417/420 |
| 3,465,681 | 8/1967 | Zimmermann | 417/420 |
| 3,520,642 | 7/1970 | Fulton | 417/420 |
| 3,588,284 | 6/1971 | Sturlason | 417/410 X |
| 3,647,314 | 3/1972 | Laessig | 417/420 X |
| 3,720,372 | 3/1973 | Jacobs | 123/41.44 X |
| 3,723,029 | 3/1973 | Laing | 417/420 |
| 3,802,804 | 4/1974 | Zimmermann | 417/420 X |
| 3,826,938 | 7/1974 | Filer | 417/420 X |
| 3,932,068 | 1/1976 | Zimmermann | 417/420 |
| 3,938,914 | 2/1976 | Zimmermann | 417/420 |
| 4,013,384 | 3/1977 | Oikawa | 417/420 X |
| 4,135,863 | 1/1979 | Davis et al. | 417/420 |
| 4,226,574 | 10/1980 | Villette | 417/420 |
| 4,308,994 | 1/1982 | Perhats | 417/420 X |
| 4,550,694 | 11/1985 | Evans | 123/41.02 |
| 4,691,668 | 9/1987 | West | 123/41.44 X |

FOREIGN PATENT DOCUMENTS

| | | | |
|---|---|---|---|
| 1538894 | 3/1970 | Fed. Rep. of Germany . | |
| 2920313 | 11/1980 | Fed. Rep. of Germany | 417/32 |

*Primary Examiner*—Tony M. Argenbright
*Assistant Examiner*—Eric R. Carlberg
*Attorney, Agent, or Firm*—Allan J. Lippa; Peter Abolins

[57] ABSTRACT

A liquid cooling system having a combined coolant pump/electric motor assembly detached from a liquid cooled internal combustion engine. Liquid coolant is circulated from a radiator, first through the engine head jacket, then through the engine block jacket and back into the radiator. A two-speed electric pump varies the liquid coolant flow rate in relation to a deviation between actual engine temperature and an optimum temperature. The combined coolant pump/electric motor assembly further combines a magnetic clutch with the electric motor such that a separate magnetic clutch is not required.

8 Claims, 3 Drawing Sheets

12
14
48
50
20
52
70
66
72
67
62
64
74
58
76
78
100a
60
82
COMMUTATOR CIRCUITRY
PWM
V Batt
100b
56
68
54

COOLING SYSTEM FOR AN INTERNAL COMBUSTION ENGINE

BACKGROUND

The field of the invention relates to cooling systems for internal combustion engines, in particular for use in automobiles.

In a liquid cooled internal combustion engine, a liquid coolant is circulated from a radiator through a block jacket in thermal communication with the cylinder block, then into a head jacket in thermal communication with the engine head, and then back into the radiator. The liquid coolant is circulated by a centrifugal pump, mounted at the front of the engine block, which has a pump impeller positioned either within the block jacket or within a casing forming an extension of the block jacket. Mechanical power is transmitted from the engine crankshaft to the impeller shaft by a belt and associated pulleys. Various water seals, bushings and bearings are required to both position and seal the impeller shaft.

In liquid circulation systems, other than automobile cooling systems, it is known to couple an electric motor to the impeller shaft of a centrifugal pump via a magnetic clutch. More specifically, the impeller is separated from the electric motor by a water-tight membrane having nonmagnetic properties. Permanent magnets are connected to both the motor shaft and the impeller shaft such that the impeller rotates in response to movement of the motor shaft. Examples of magnetic clutches are described in U.S. Pat. Nos. 3,411,450; 3,465,681; 3,306,221; 3,520,642; 3,647,314; 3,723,029; 3,802,804; 3,826,938; 3,932,068; 3,938,914; 4,013,384; 4,135,863; 4,226,574; and 4,308,994.

Publication of German patent application OLS No. 1,538,894 shows the adaption of an impeller shaft, having permanent magnets attached thereto, for use as the axial rotor of a DC motor. More specifically, permanent magnets are shown connected to the impeller shaft and separated from the motor coils by a membrane. It appears that this configuration combines both the DC motor and magnetic clutch as a single integral unit.

It is believed that the above-described magnetically coupled pumps have not been used in automobile coolings systems due to at least the following problems. First, there is inherent inefficiency in generating electrical power from the engine through an alternator, and then converting the electrical power back into mechanical power via an electric motor for driving the impeller. Second, the torque output of the above-described magnetically coupled pumps may be inadequate for use in an automobile cooling system.

A problem with all current approaches to automobile cooling systems is that liquid coolant enters the block jacket first and then, after the liquid coolant has received heat transfer from the engine block, the coolant enters the head jacket. Accordingly, the cylinder head may not be cooled sufficiently to prevent engine operating abnormalities, such as knocking and pre-ignition. Similiarly, the engine block may be overcooled thereby reducing lubricating efficiency in the engine block. The inventors herein have recognized that these engine operating abnormalities may be reduced by reversing the conventional flow of coolant such that the cylinder head is cooled first. In addition, by cooling the engine block with coolant which has been heated by the cylinder head, more efficient lubrication will be achieved in the engine block.

The inventors herein have recognized that another problem with automobile cooling systems is that the flow rate of liquid coolant is designed for worst case engine operation such as during heavy load operation. Thus, during normal engine operating conditions, an excess flow of coolant results in operating temperatures which are too low for efficient operation. In addition, driving the coolant pump at a higher speed than is required during normal engine operating conditions results in a considerable waste of engine output power.

SUMMARY OF THE INVENTION

It is an object of the present invention to optimize engine temperature conditions throughout the engine and over the entire operating range of the engine. It is another object of the invention to minimize the power required to drive an engine cooling system.

The above and other problems are overcome, and object achieved, by providing a novel liquid cooling system which circulates a liquid coolant from a radiator through the head jacket and then through the block jacket back into the radiator as claimed herein. In accordance with an embodiment of the invention, the liquid cooling system comprises: a centrifugal coolant pump having an outlet coupled to the head jacket and an inlet coupled to the radiator; an electric motor coupled to the pump for rotating the pump to force the liquid coolant from the radiator into the head jacket and from the head jacket into the block jacket; a temperature sensor coupled to the engine for providing a measurement of engine temperature; and electrical means responsive to the temperature sensor and coupled to the electric motor for supplying electrical power to the electric motor in an inverse relation to the engine temperature.

By cooling the head jacket before the block jacket, an advantage is obtained of operating the cylinder head at a lower temperature than is obtainable with prior cooling systems thereby avoiding engine operating abnormalities such as, for example, pre-ignition and knocking. Further, by maintaining the engine block at a higher temperature, greater efficiency in lubrication is achieved.

Additional advantages are obtained by varying the electrical power applied to the coolant pump as described hereinabove. One advantage is that the electrical power supplied to the coolant pump is minimized. Accordingly, the power requirement of the cooling system herein is less than in conventional systems. Another advantage is that during normal engine operating conditions, the coolant pump is operated at a flow rate which enables an engine operating temperature more closely related to the most efficient operating temperature. Stated another way, during normal engine operating conditions, excess engine cooling, which is indicative of conventional cooling systems, is avoided.

Preferably, the coolant pump comprises: a housing; a water-tight partition dividing the housing into a water-tight first compartment and a second compartment, the first compartment being coupled to both the inlet and the outlet, the partition including a substantially tubular membrane constructed of a nonmagnetic material and having one closed end contiguous to the first compartment and an open end contiguous to the second compartment; and an impeller assembly rotatably mounted within the first compartment and axially aligned with the tubular membrane, the impeller assembly including a rotatable collar adapted to partially surround the tubular membrane. Preferably, the electric motor comprises an electronically commutated DC motor, including: a plurality of magnets symmetrically positioned on the collar to define a circumferential rotor for rotating around the outer surface of the tubular membrane within the first compartment; and a plurality of electrically conducting coils fixedly positioned in the second compartment adjacent to the tubular membrane; and electronic commutating means coupled to the electrical means and the coils for applying the electrical power to the coils to rotate the circumferential rotor.

Accordingly, the coolant pump and DC motor are integrally formed wherein the circumferential collar, having permanent magnets positioned therein, forms an outer circumferential rotor of the DC motor. An advantage is thereby obtained of delivering a higher torque to the impeller assembly through the circumferential rotor, whereas a conventional motor would deliver less torque through an axially disposed rotor coupled to the impeller. Another advantage is that a highly efficient and compact integrally formed motor and pump assembly is provided. Still another advantage is that the water seals, bushings and bearings required to secure the impeller shaft in conventional cooling systems are eliminated.

DESCRIPTION OF THE PREFERRED EMBODIMENT

Figure 1:
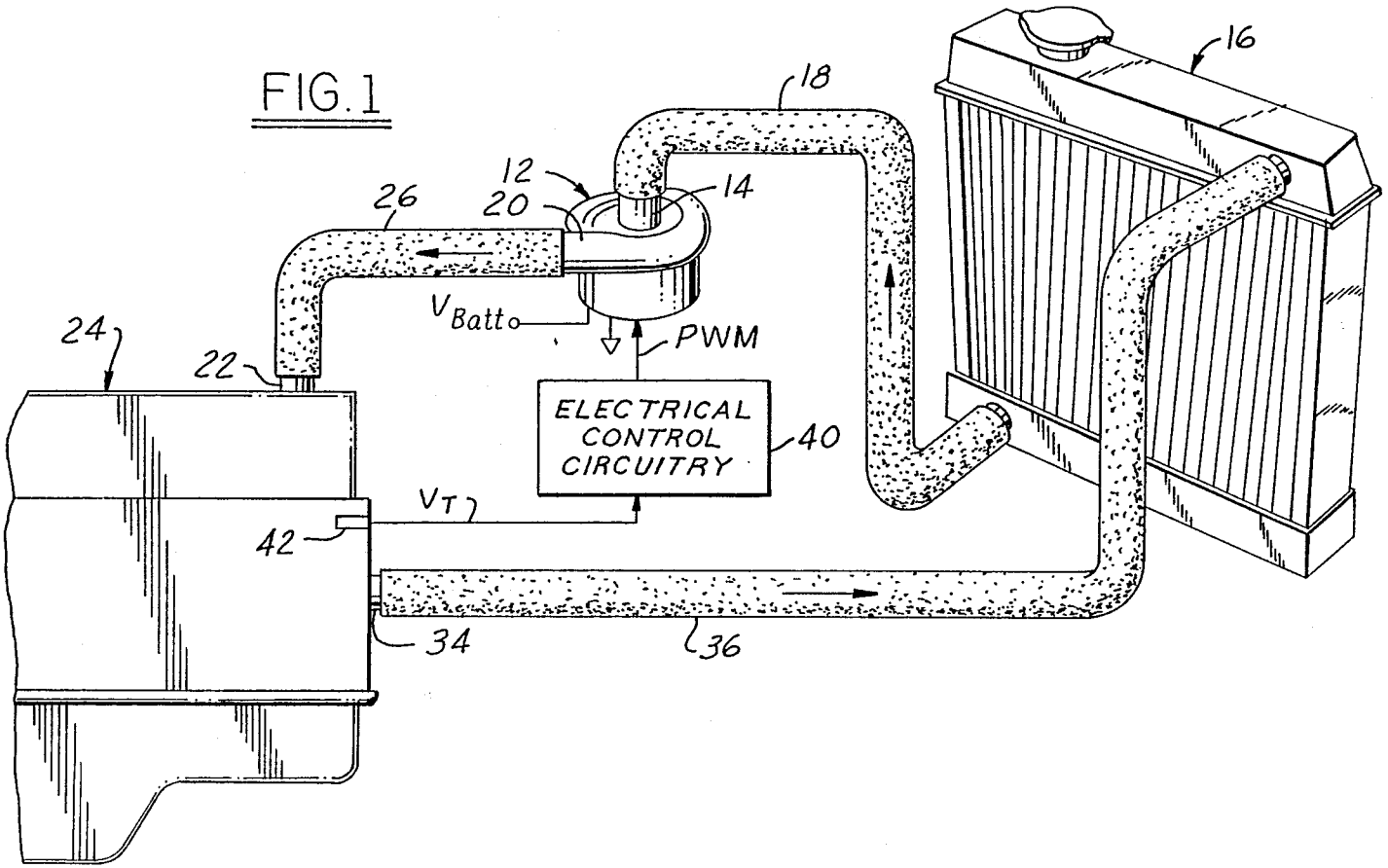
FIG. 1 is a schematic of a cooling system, including electrical control circuitry, in accordance with the present invention.

Referring first to FIG. 1, coolant pump/electric motor assembly 12 is shown having liquid coolant inlet 14 coupled to radiator 16 via pipe 18. Coolant pump/electric motor assembly 12 is also shown having liquid coolant outlet 20 coupled to head jacket inlet 22 of liquid cooled internal combustion engine 24 via pipe 26. Internal combustion engine 24 includes a conventional head jacket 30 (not shown) defining a liquid compartment in thermal communication with the engine cylinder head (not shown). Head jacket 30 is coupled to conventional block jacket 32 (not shown) which defines another liquid compartment in thermal communication with the engine cylinder block (not shown). Block jacket 32 is coupled to radiator 16 via block jacket outlet 34 and pipe 36.

During cooling operation, coolant pump/electric motor assembly 12 circulates liquid coolant from radiator 16 through head jacket 30, into block jacket 32, and back into radiator 16. Accordingly, the coolest liquid coolant in the cooling system is in thermal communication with the cylinder head. Further, the engine block receives coolant which has been preheated by the cylinder head. The advantages thereby maintained are that the occurrence of engine operating abnormalities, such as knocking and pre-ignition, are reduced and more efficient engine block lubrication is achieved. Thus, some of the problems of conventional cooling systems are overcome wherein the pump impeller is coupled directly to the block jacket resulting in the cooling of the engine block first.

It is also noted that since coolant pump/electric motor assembly 12 does not require mechanical connection with the engine block, it may be located in any convenient position within the engine compartment. This feature is particularly advantageous for east/west mounted engines.

Continuing with FIG. 1, electrical control circuitry 40 controls, via signal PWM, the electrical power applied to coolant pump/electric motor assembly 12 in response to electrical signal VT from engine temperature sensor 42. As described in greater detail later herein with particular reference to FIG. 3, a predetermined amount of electrical power is applied to coolant pump/electric motor assembly 12 during normal engine operation for maintaining the temperature of engine 24 near an optimum operating temperature. In the event of a rise in engine temperature beyond a threshold temperature, such as during heavy load conditions, the electrical power applied is increased thereby increasing the flow of liquid coolant until engine temperature returns to the optimum or threshold temperature.

Since the rate of coolant flow is a function of engine temperature, rather than engine speed as in the case of conventional cooling systems, the engine temperature is maintained near an optimum level. Stated another way, by maintaining the flow rate as a function of measured temperature, the overcooling of prior approaches is avoided. Further, by reducing the rate of flow during normal engine operating conditions, rather than maintaining a flow rate designed for worst case conditions, the power required to drive the cooling system is minimized.

Figure 2:
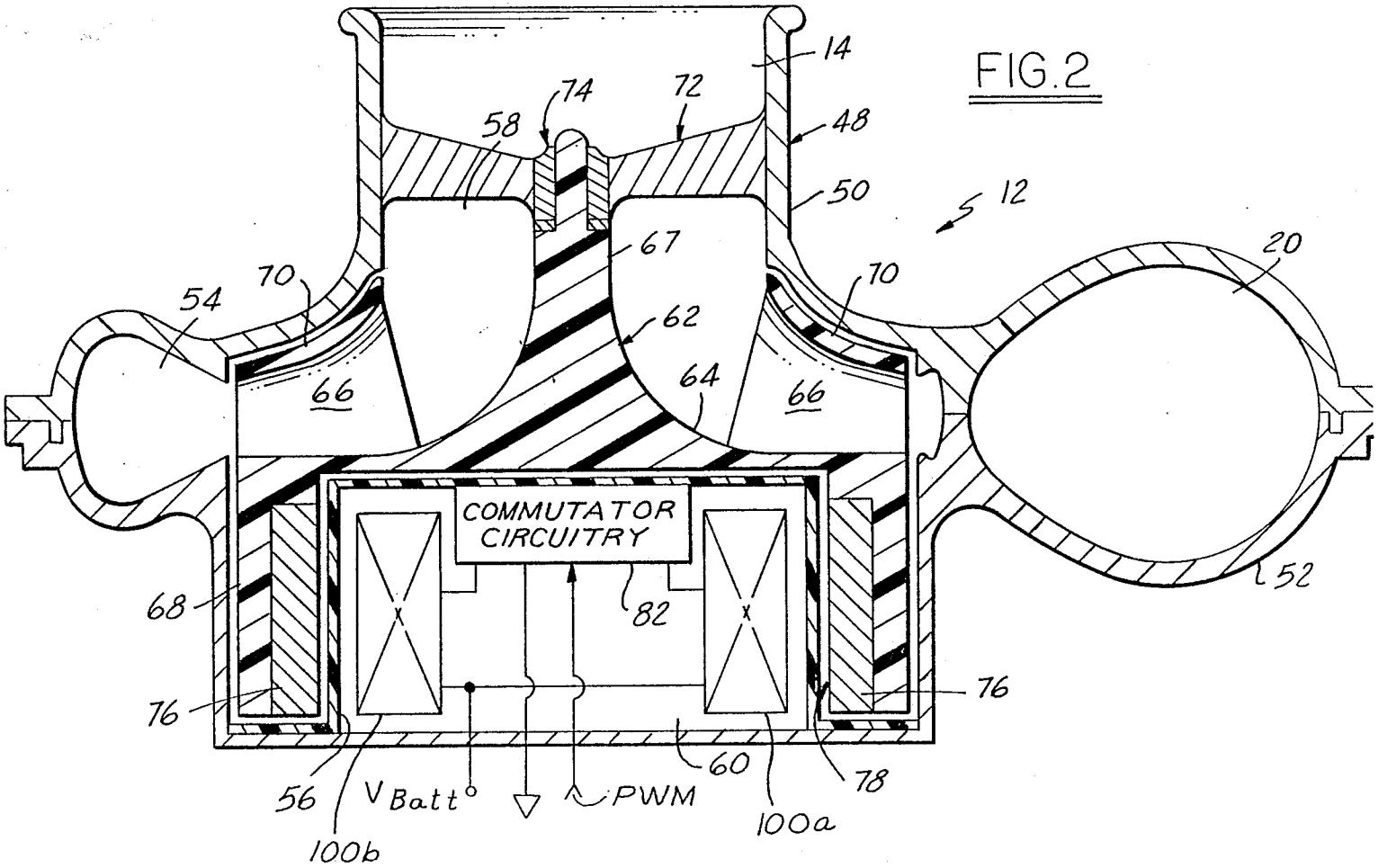
FIG. 2 is a cross-sectional view of a portion of the cooling system shown in FIG. 1.

Referring now to FIG. 2, a cross-sectional view of coolant pump/electric motor assembly 12 is shown as an integrally formed centrifugal pump and electronically commutated DC motor. More specifically, housing 48 is shown having an upper housing portion 50 and lower housing portion 52, each having recesses formed along a portion of their mating surfaces thereby forming conventional volute 54. Water-tight tubular membrane 56, constructed of a nonmagnetic material such as plastic, is shown connected to housing 48 for defining pump compartment 58 and electronics compartment 60. Pump compartment 58 is shown having axial liquid inlet 14, and liquid outlet 20 defined as an opening of volute 54.

Impeller assembly 62 is shown integrally formed from a plastic material and defined by: circular base 64 having conventional fins 66 attached thereto; axial shaft 67 extending upward from base 64; and cylindrical collar 68 extending downwardly from base 64 and adapted to partially surround tubular membrane 56. Bracket 72 is shown connected to housing 50 for axially positioning bearing assembly 74 within inlet 14. Shaft 67 is shown coupled to bearing assembly 74 for positioning impeller 62 within pump compartment 58.

In operation, rotation of impeller 62 rotates impeller fins 66 thereby drawing liquid from inlet 14 and forcing the liquid into volute 54 and out through outlet 20.

Permanent magnets 76 are shown attached to collar 68 thereby defining circumferential rotor 78. As described in greater detail hereinafter, with particular reference to FIG. 3, circumferential rotor 78 defines a novel circumferential rotor of an electronically commutated DC motor for rotating impeller 62. In general terms, the rest of the electronically commutated DC motor includes three stator coils $\mathbf{80}_{a-c}$ located in electronics compartment 60 and separated from circumferential rotor 78 by tubular membrane 56. In response to PWM signal from electrical control circuitry 40, and also in response to the angular position of circumferential rotor 78, commutator circuitry 82 applies or switches battery power ($V_{Batt}$) to each of the stator coils $\mathbf{80}_{a-c}$ in a three-phase relationship. That is, each one of the stator coils $\mathbf{80}_{a-c}$ is actuated for 120° angular movement of circumferential rotor 78. Permanent magnets 76 rotate circumferential rotor 78 in response to the magnetic flux passing through tubular membrane 56 from stator coils $\mathbf{80}_{a-c}$. Thus, a magnetic clutch for isolating the liquid coolant from the electronics and the DC motor are combined together. Further, the unique circumferential rotor 76 provides significantly more torque to impeller 62 than a conventional axial rotor.

Figure 3:
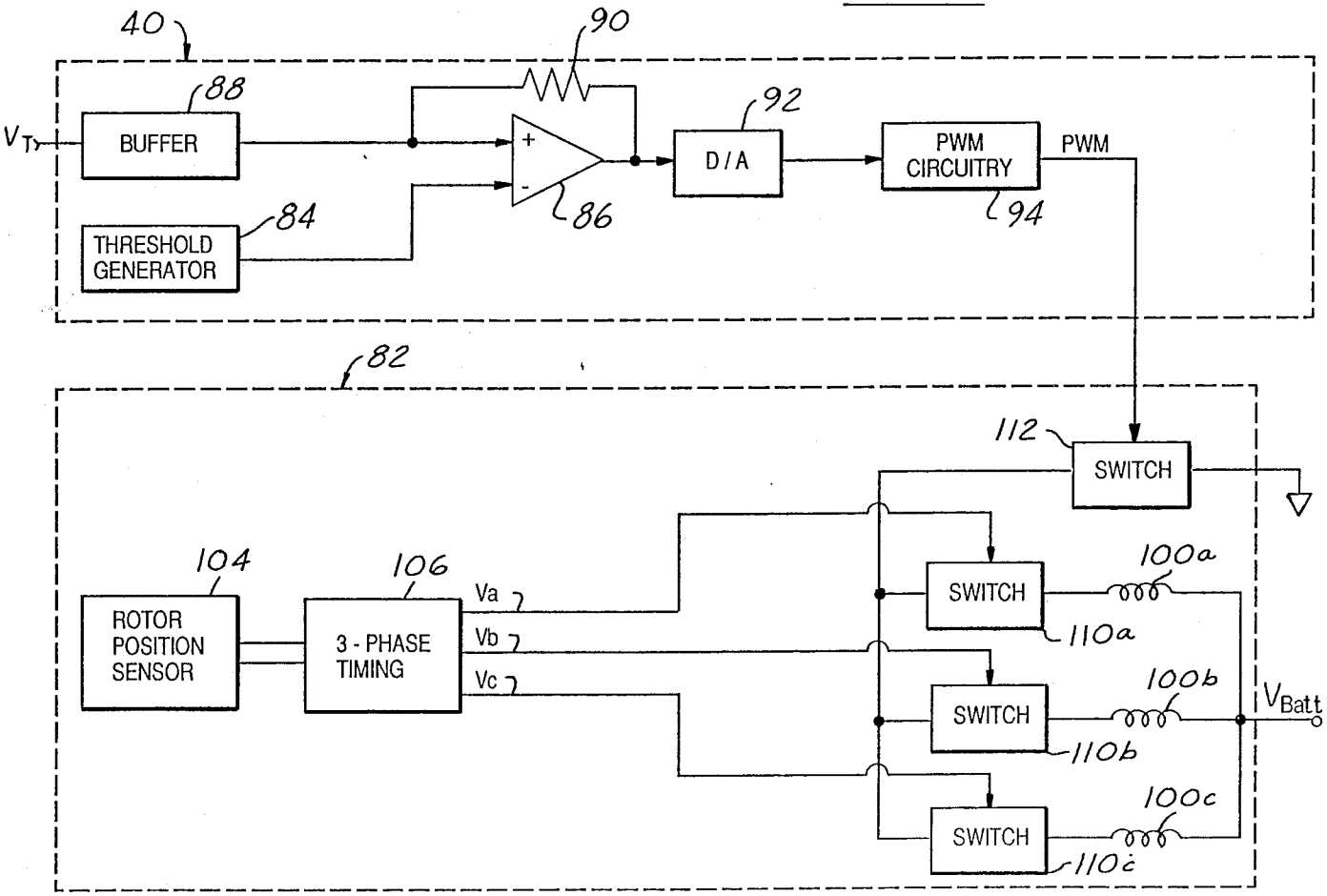
FIG. 3 is an electrical schematic of the electrical circuitry shown in FIGS. 1 and 2.

With reference to FIG. 3, electrical control circuitry 40 and commutator circuitry 82 are described in more detail. Referring first to electrical control circuitry 40, threshold generator 84, preferably a selectable source of electrical signals such as a potentiometer, provides an electrical threshold signal representative of the desired or optimal operating temperature of engine 24 to the negative input terminal of comparator 86. Buffer 88, preferably comprising a differential amplifier suitable for impedance matching, couples signal $V_T$ from engine temperature sensor 82 to the positive input of comparator 86. Feedback resistor 90 is shown coupled between the output terminal and the positive input terminal of comparator 86 for setting the hysteresis of comparator 86 in a conventional manner. When buffer signal $V_T$ from buffer 88 is greater than the threshold temperature signal by at least the hysteresis value, the output of comparator 86 is a logic "1", otherwise the output is a logic "0". D/A converter 92 translates the voltage of the logic states from comparator 86 to the appropriate voltage levels required by pulse width modulating circuitry 94, preferably an off the shelf chip sold by National Semiconductor (Part No. LM3524). The output signal PWM of pulse width modulating circuitry 94 is a square wave having a 60% duty cycle when the output of comparator 86 is at logic "0" and a 100% duty cycle when the output of comparator 86 is at logic "1". As described in greater detail hereinafter, signal PWM switches or applies electrical power to coolant pump/electric motor assembly 12.

Continuing with FIG. 3, and now referring particularly to electronic commutator circuitry 82, rotor position sensor 104, preferably a conventional optical position sensor, provides three-phase timing circuitry 106 with an electrical signal representative of the angular position of circumferential rotor 78. Preferably, these signals comprise two digital signals which encode each $2\pi/3$ phase change in angular position of circumferential rotor 78.

Three-phase timing circuitry 106 generates three electronic phase signals, $V_{a-c}$, each having a positive voltage amplitude only during one $2\pi/3$ position of circumferential rotor 78. Each phase signal $V_{a-c}$, actuates the corresponding power switch $\mathbf{110}_{a-c}$, preferably conventional power MOS FETS. Stated another way, power switches $\mathbf{110}_{a-c}$ are switched from a nonconducting to a conducting state in a conventional manner by respective phase signals $V_{a-c}$.

Power switches $\mathbf{110}_{a-c}$ are shown connected in series with respective stator coils $\mathbf{100}_{a-c}$ between the automobile battery voltage $V_{Batt}$ and power switch 112, preferably a conventional power MOS FET. Power switch 112, shown actuated by signal PWM, is connected in series between power switches $\mathbf{110}_{a-c}$ and the automobile ground or signal return.

In accordance with the above description, each of the stator coils $\mathbf{100}_{a-c}$ is actuated when both the corresponding one of the phase signals $V_{a-c}$ and signal PWM signal are actuated. That is, when signal PWM is actuated, the electronic commutator circuitry 82 provides conventional phase commutation of stator coils $\mathbf{100}_{a-c}$ thereby rotating circumferential rotor 78 and, accordingly, impeller 62. Thus, the speed of rotation of impeller 62 and corresponding liquid flow rate provided by coolant pump/electric motor assembly 12 is directly related to the duty cycle of signal PWM.

In operation, when the engine temperature is below the threshold temperature, signal PWM is at a 60% duty cycle whereby coolant pump/electric motor assembly 12 provides a liquid flow rate of 20 gpm. Similarly, when the engine temperature is above the threshold temperature, signal PWM is at a 100% duty cycle resulting in a 40 gpm liquid flow rate from coolant pump/electric motor assembly 12.

This concludes the description of the preferred embodiment. The reading of it by those skilled in the art will bring to mind many alterations and modifications without departing from the spirit and scope of the invention. For example, it is apparent that a variable liquid flow rate may be achieved in direct relation to the engine temperature rather than the two-speed flow rate described herein with reference to the preferred embodiment. Accordingly, it is intended that the scope of the invention be limited only by the following claims.

I claim:

1. A liquid cooling system for circulating a liquid coolant through a radiator and an internal combustion engine having a cylinder head thermally communicating with a cooling head jacket and an engine block thermally communicating with a cooling block jacket, the head jacket being coupled to the block jacket for circulating the liquid coolant through the engine, the liquid cooling system comprising:

a centrifugal coolant pump having an outlet coupled to the head jacket and an inlet coupled to the radiator, said pump comprising a housing having both said inlet and said outlet positioned therein, a water-tight partition dividing said housing into a water-tight first compartment and a second compartment, said first compartment being coupled to both said inlet and said outlet, said partition including a substantially tubular membrane constructed of a nonmagnetic material and having one closed end contiguous to said first compartment and an open end contiguous to said second compartment, and an impeller assembly rotatably mounted within said first compartment and axially aligned with said tubular membrane, said impeller assembly including a rotatable collar adapted to partially surround said tubular membrane;

an electric motor coupled to said pump for rotating said pump to force the liquid coolant from the radiator into the head jacket and from the head jacket into the block jacket;

a temperature sensor coupled to the engine for providing an indication of engine temperature; and electrical power means connected to said electric motor for supplying electrical power to said electric motor in a direct relation to said engine temperature.

2. The cooling system recited in claim 1 wherein said electric motor comprises an electrically commutated DC motor, including:

a plurality of magnets symmetrically positioned on said collar to define a circumferential rotor for rotating around the outer circumference of said tubular membrane within said first compartment;

a plurality of electrically conducting coils fixedly positioned in said second compartment adjacent to said tubular membrane; and electronic commutating means coupled to said electrical means and said coils for applying said electrical power to said coils to rotate said circumferential rotor.

3. The cooling system recited in claim 2 wherein said electrical power means supplies an electrical square wave having a duty cycle directly related to said engine temperature.

4. The cooling system recited in claim 3 wherein said electronic commutating means further comprises:

a position sensor for providing an indication of the angular position of said circumferential rotor; and switching means coupled to said coils and responsive to both said electrical power means and said position sensor for applying said electrical square wave to each of said coils as a function of the angular position of said rotor.

5. A liquid cooling system for circulating a liquid coolant through a radiator and an internal combustion engine having a cylinder head thermally communicating with a cooling head jacket and an engine block thermally communicating with a cooling block jacket, the head jacket being coupled to the block jacket for circulating the liquid coolant through the engine, the liquid cooling system comprising:

a centrifugal coolant pump having an outlet coupled to the head jacket and an inlet coupled to the radiator, said pump comprising a housing having both said inlet and said outlet positioned therein, a water-tight partition dividing said housing into a water-tight first compartment and a second compartment, said first compartment being coupled to both said inlet and said outlet, said partition including a substantially tubular membrane constructed of a nonmagnetic material and having one closed end contiguous to said first compartment and an open end contiguous to said second compartment, and an impeller assembly rotatably mounted within said first compartment and axially aligned with said tubular membrane, said impeller assembly including a rotatable collar adapted to partially surround said tubular membrane;

an electric motor coupled to said pump for rotating said pump to force the liquid coolant from the radiator into the head jacket and from the head jacket into the block jacket;

a temperature sensor coupled to the engine for providing a measurement of engine temperature; and electrical power means responsive to said comparator for supplying a first quantity of electrical power to said electric motor when said engine temperature is below said threshold temperature and for applying a second quantity of electrical power when said engine temperature is above said threshold temperature.

6. The cooling system recited in claim 5 wherein said electric motor comprises an electrically commutated DC motor, including:

a plurality of magnets symmetrically positioned on said collar to define a circumferential rotor for rotating around the outer circumference of said tubular membrane within said first compartment;

a plurality of electrically conducting coils fixedly positioned in said second compartment adjacent to said tubular membrane; and electronic commutating means coupled to said electrical means and said coils for applying said electrical power to said coils to rotate said circumferential rotor.

7. The cooling system recited in claim 6 wherein said first quantity of electrical power supplied by said electrical power means comprises a square wave having a first predetermined duty cycle and wherein said second quantity of electrical power supplied by said electrical power means comprises a square wave having a second predetermined duty cycle.

8. The cooling system recited in claim 7 wherein said electronic commutating means further comprises:

a position sensor for providing an indication of the angular position of said circumferential rotor; and switching means coupled to said coils and responsive to both said electrical power means and said position sensor for applying said electrical power to each of said coils as a function of the angular position of said rotor.

* * * * *